US010258522B2

(12) United States Patent
Kalf et al.

(10) Patent No.: US 10,258,522 B2
(45) Date of Patent: Apr. 16, 2019

(54) SEAT ARRANGEMENT AND ELECTRICALLY POWERED WHEELCHAIR COMPRISING THE SAME

(71) Applicant: Permobil AB, Timrä (SE)

(72) Inventors: Erik Kalf, Matfors (SE); Anders Edholm, Harnosand (SE)

(73) Assignee: PERMOBIL AB (SE)

( * ) Notice: Subject to any disclaimer, the term of this patent is extended or adjusted under 35 U.S.C. 154(b) by 18 days.

(21) Appl. No.: 15/536,509

(22) PCT Filed: Dec. 17, 2015

(86) PCT No.: PCT/EP2015/080230
§ 371 (c)(1),
(2) Date: Jun. 15, 2017

(87) PCT Pub. No.: WO2016/097148
PCT Pub. Date: Jun. 23, 2016

(65) Prior Publication Data

US 2017/0360633 A1 Dec. 21, 2017

(30) Foreign Application Priority Data

Dec. 18, 2014 (EP) ..... 14198783

(51) Int. Cl.
*A61G 5/10* (2006.01)
*A61G 5/12* (2006.01)

(52) U.S. Cl.
CPC ..... *A61G 5/1067* (2013.01); *A61G 5/122* (2016.11); *A61G 2203/70* (2013.01)

(58) Field of Classification Search
CPC ... A61G 5/1067; A61G 5/122; A61G 2203/70
See application file for complete search history.

(56) References Cited

U.S. PATENT DOCUMENTS 5,788,330 A * 8/1998 Ryan ..... B60N 2/2354 297/367 R
5,997,021 A * 12/1999 Robinson ..... A61G 5/00 280/250.1

(Continued)

FOREIGN PATENT DOCUMENTS

CN 101905665 A 12/2010
CN 102205808 A 10/2011

(Continued)

OTHER PUBLICATIONS

European Search Report for Application No. EP14198783.4 dated Jun. 10, 2015, 4 pages.

(Continued)

*Primary Examiner* — Joseph M Rocca
*Assistant Examiner* — Michael R Stabley
(74) *Attorney, Agent, or Firm* — McAndrews, Held & Malloy, Ltd.

(57) ABSTRACT

The present disclosure relates to a seat arrangement (1) for an electrically powered wheelchair, wherein the seat arrangement comprises (1): a mounting arrangement for mounting the seat arrangement (1) to a chassis of an electrically powered wheelchair, a seat frame (3), a backrest frame (5), a backrest actuator (7), wherein the backrest frame (5) is pivotally coupled to the seat frame (3), forming a first pivot axis (A1), and wherein the backrest frame (5) is pivotally coupled to the backrest actuator (7), forming a translatable second pivot axis (A2), a retaining mechanism (11) arranged to retain the backrest frame (5) in an upright position while the backrest frame (5) is subjected to a forward-tilting force smaller than a threshold value, wherein the retaining mechanism (11) is arranged to allow movement of the backrest frame (5) to a forward-tilted position when the backrest frame (5) is subjected to a forward-tilting force equal to or greater than the threshold value, and a locking (Continued)

mechanism (13) arranged to lock the backrest frame (5) in the forward-tilted position. An electrically powered wheelchair comprising a seat arrangement is also disclosed herein.

14 Claims, 8 Drawing Sheets

(56) References Cited

U.S. PATENT DOCUMENTS 6,027,132 A * 2/2000 Robinson ..... A61G 5/00 16/19
6,032,976 A * 3/2000 Dickie ..... A61G 5/00 180/65.6
6,129,415 A * 10/2000 Galloway ..... A61G 5/1067 297/423.26
6,206,393 B1 * 3/2001 Mascari ..... A61G 5/1075 280/220
6,276,704 B1 * 8/2001 Suiter ..... A61G 5/00 180/907
6,296,311 B1 * 10/2001 Bonk ..... B60N 2/2227 297/367 R
6,409,265 B1 * 6/2002 Koerlin ..... A61G 5/006 297/325
6,776,430 B2 * 8/2004 White ..... A61G 5/045 180/907
6,968,598 B2 * 11/2005 Becker ..... B60N 2/20 16/349
8,783,770 B2 * 7/2014 Tanaka ..... A47C 1/0342 297/284.3
8,973,997 B2 * 3/2015 Green ..... A61G 5/1067 297/284.11
9,084,708 B2 * 7/2015 Horvath ..... A61G 5/1059
2004/0049841 A1 3/2004 Brotherston et al.
2006/0115890 A1 6/2006 Muller et al.
2009/0315376 A1 * 12/2009 Nishiwaki ..... A61G 5/006 297/301.2
2016/0022039 A1 * 1/2016 Paul ..... A47C 1/0342 297/88

FOREIGN PATENT DOCUMENTS

CN 202235987 U 5/2012
CN 103692938 A 4/2014
CN 103692939 A 4/2014
WO 9729923 A1 8/1997
WO 0191688 A1 12/2001

OTHER PUBLICATIONS

International Search Report and Written Opinion corresponding to International Patent Application No. PCT/EP2015/080230, dated Mar. 22, 2016.
First Office Action for Chinese Application No. 201580068698.3 dated Jun. 20, 2018, 9 pages.

* cited by examiner

SEAT ARRANGEMENT AND ELECTRICALLY POWERED WHEELCHAIR COMPRISING THE SAME

CROSS-REFERENCE TO RELATED APPLICATIONS/INCORPORATION BY REFERENCE

The present application is the U.S. national phase under § 371 of International Application No. PCT/EP2015/080230, having an international filing date of Dec. 17, 2015, which claims priority to EP Patent Application No. 14198783.4, filed Dec. 18, 2014. Each of the above-mentioned prior-filed applications is hereby expressly incorporated herein by reference in its entirety.

TECHNICAL FIELD

The present disclosure generally relates to electrically powered wheelchairs. In particular it relates to a seat arrangement for an electrically powered wheelchair and to an electrically powered wheelchair comprising a seat arrangement.

BACKGROUND

When a wheelchair is to be moved a greater distance it may be transported in a motor vehicle such as a bus or a car. The wheelchair occupant may occupy the wheelchair seat during such transport. For this purpose, the interior of the vehicle may be specially constructed or modified to be able to receive a wheelchair.

In order to transport the wheelchair, it is secured inside the vehicle for example by means of straps, and the wheelchair occupant may be strapped to the wheelchair for example by means of a safety belt. An example of a base unit for docking and securing a wheelchair in a vehicle, e.g. in the driving position, is disclosed in EP1774941. By securing the wheelchair in a vehicle, movement of the wheelchair relative to the vehicle is restricted in the event of an accident.

Even though a wheelchair is properly secured in a vehicle, a wheelchair occupant may of course still suffer injuries in the event of an accident. Neck injuries are for example common as a result of a rear collision or a frontal collision, during which the head of a wheelchair occupant is thrown forward and then rebounds backwards. Neck injuries are in general obtained due to an acceleration-deceleration motion of the head.

It is thus desirable to provide protection from neck injuries of wheelchair occupants in the event of a collision during transportation in a vehicle.

SUMMARY

In view of the above, a general object of the present disclosure is to provide a seat arrangement for an electrically powered wheelchair, and an electrically powered wheelchair, which solve or at least mitigate the problems of the prior art.

Hence, according to a first aspect of the present disclosure there is provided a seat arrangement for an electrically powered wheelchair, wherein the seat arrangement comprises a mounting arrangement for mounting the seat arrangement to a chassis of an electrically powered wheelchair, a seat frame, a backrest frame, a backrest actuator, wherein the backrest frame is pivotally coupled to the seat frame, forming a first pivot axis, and wherein the backrest frame is pivotally coupled to the backrest actuator, forming a translatable second pivot axis, a retaining mechanism arranged to retain the backrest frame in an upright position while the backrest frame is subjected to a forward-tilting force smaller than a threshold value, wherein the retaining mechanism is arranged to allow movement of the backrest frame to a forward-tilted position when the backrest frame is subjected to a forward-tilting force equal to or greater than the threshold value, and a locking mechanism arranged to lock the backrest frame in the forward-tilted position.

An effect obtainable by means of forward-tilting of the backrest frame to the forward-tilted position and locking the backrest frame in this position in the event that the forward-tilting force acting on the backrest frame is equal to or greater than the threshold value, is that the risk of whiplash injuries may be reduced. Due to the locked forward-tilted position of the backrest frame, the return motion of a seat occupant's head upon impact, such as rear collision impact, will be significantly reduced. The forward-tilted backrest frame does hence in a sense catch the head of the wheelchair occupant during the return motion of the head towards the backrest frame.

With a forward-tilting force is meant a force that acts on the backrest frame and which has a component that tries to bring the backrest frame to a forward-tilting position.

According to one embodiment the retaining mechanism is arranged to retain the backrest actuator in a first position while the backrest frame is subjected to the forward-tilting force smaller than a threshold value, wherein the backrest frame is arranged to pivot about the first pivot axis and the second pivot axis to obtain a forward-tilted position when the backrest frame is subjected to a forward-tilting force equal to or greater than the threshold value, wherein the retaining mechanism is arranged to allow movement, corresponding to the translation of the second pivot axis, of the backrest actuator to a second position, and wherein the locking mechanism is arranged to lock the backrest actuator in the second position to thereby lock the backrest frame in the forward-tilted position.

Thus, according to one embodiment there is provided a seat arrangement for an electrically powered wheelchair, wherein the seat arrangement comprises a mounting arrangement for mounting the seat arrangement to a chassis of an electrically powered wheelchair, a seat frame, a backrest frame, a backrest actuator, wherein the backrest frame is pivotally coupled to the seat frame, forming a first pivot axis, and wherein the backrest frame is pivotally coupled to the backrest actuator, forming a translatable second pivot axis, a retaining mechanism arranged to retain the backrest actuator in a first position while the backrest frame is subjected to a forward-tilting force smaller than a threshold value, wherein the backrest frame is arranged to pivot about the first pivot axis and the second pivot axis, thereby translating the second pivot axis, to obtain a forward-tilted position when the backrest frame is subjected to a forward-tilting force equal to or greater than the threshold value, wherein the retaining mechanism is arranged to allow movement, corresponding to the translation of the second pivot axis, of the backrest actuator to a second position, and a locking mechanism arranged to lock the backrest actuator in the second position to thereby lock the backrest frame in the forward-tilted position According to one embodiment the backrest frame is arranged to pivot about the first pivot axis and the second pivot axis to the forward-tilted position when an equilibrium state acting about the first pivot axis is broken by the forward-tilting force.

One embodiment comprises a backrest actuator bracket attached to the seat frame, wherein the backrest actuator is fixedly attached to the backrest actuator bracket.

According to one embodiment the locking mechanism is arranged to lock the backrest actuator bracket relative to the seat frame to thereby lock the backrest actuator in the second position.

One embodiment comprises a first fastener, wherein the seat frame has a first seat frame through-opening and the backrest actuator bracket has a first backrest actuator bracket through-opening, wherein the first fastener is arranged in the first seat frame through-opening and in the first backrest actuator bracket through-opening.

According to one embodiment the first fastener, the first seat frame through-opening and first backrest actuator bracket through-opening form the retaining mechanism.

One embodiment comprises a second fastener, wherein the seat frame has a second seat frame through-opening and the backrest actuation bracket has a first slotted backrest actuation bracket through-opening wherein the second fastener is arranged in the second seat frame through-opening and slidably arranged in the first backrest actuation bracket slotted through-opening.

According to one embodiment the seat frame comprises a keyway and the backrest actuator bracket comprises a biased key which form the locking mechanism, wherein the first fastener is designed to break when the backrest frame is subjected to a forward-tilting force equal to or greater than the threshold value allowing sliding of the backrest actuator bracket relative to the seat frame, wherein the biased key is arranged to engage the keyway to lock the backrest actuator in the second position.

According to one embodiment the first fastener has a first mechanical strength and the second fastener has a second mechanical strength, wherein the second mechanical strength is higher than the first mechanical strength.

According to one embodiment the locking mechanism comprises a leaf spring, wherein the key is biased by the leaf spring.

One embodiment comprises a third fastener, wherein the seat frame comprises a first seat frame slotted through-opening, and wherein the backrest actuator bracket comprises a second backrest actuator bracket through-opening, wherein the third fastener is arranged in the second backrest actuator bracket through-opening and slidably arranged in the first seat frame slotted through-opening.

According to one embodiment the backrest actuator comprises the backrest actuator comprises the retaining member and the locking member.

According to a second aspect of the present disclosure there is provided an electrically powered wheelchair comprising a chassis, and a seat arrangement according to the first aspect, attached to the chassis.

Generally, all terms used in the claims are to be interpreted according to their ordinary meaning in the technical field, unless explicitly defined otherwise herein. All references to "a/an/the element, apparatus, component, means, etc. are to be interpreted openly as referring to at least one instance of the element, apparatus, component, means, etc., unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

In general, the seat arrangements disclosed herein comprise a seat frame, a backrest frame, a backrest actuator, a retaining mechanism and a locking mechanism. The backrest frame is pivotally coupled to the seat frame, forming a first pivot axis, and to the backrest actuator, forming a second pivot axis. In normal operation, the backrest actuator is by means of an electric motor arranged to manoeuvre the backrest frame by translating the second pivot axis. The backrest frame is thereby pivoted about the second pivot axis and the first pivot axis simultaneously, whereby the backrest frame is pivoted for example backwards relative to the seat frame.

The retaining mechanism normally retains the backrest actuator in a first position in which the backrest actuator is able to manoeuvre the backrest frame. However, when a forward-tilting force larger than a threshold value acts on the backrest frame, as a result of e.g. an impact or collision, due to the momentum of the backrest frame the retaining mechanism releases the backrest actuator from the first position whereby the backrest actuator moves towards a second position relative to the seat frame. The release of the backrest actuator from the first position is provided by a translation of the second pivot axis. This translation occurs because the backrest frame is moved towards a forward-tilting position with pivoting about the first pivot axis. The backrest actuator is hence in a sense dragged to the second position. As the backrest actuator obtains the second position it is locked in this position by the locking means. As a result, the backrest frame is also locked in the forward-tilted position. The head of an occupant of an electrically powered wheelchair may thereby be caught by the forward-tilted backrest frame, reducing the rearward head movement.

An example of a seat arrangement will now be described with reference to FIGS. 1 and 2.

Figure 1:
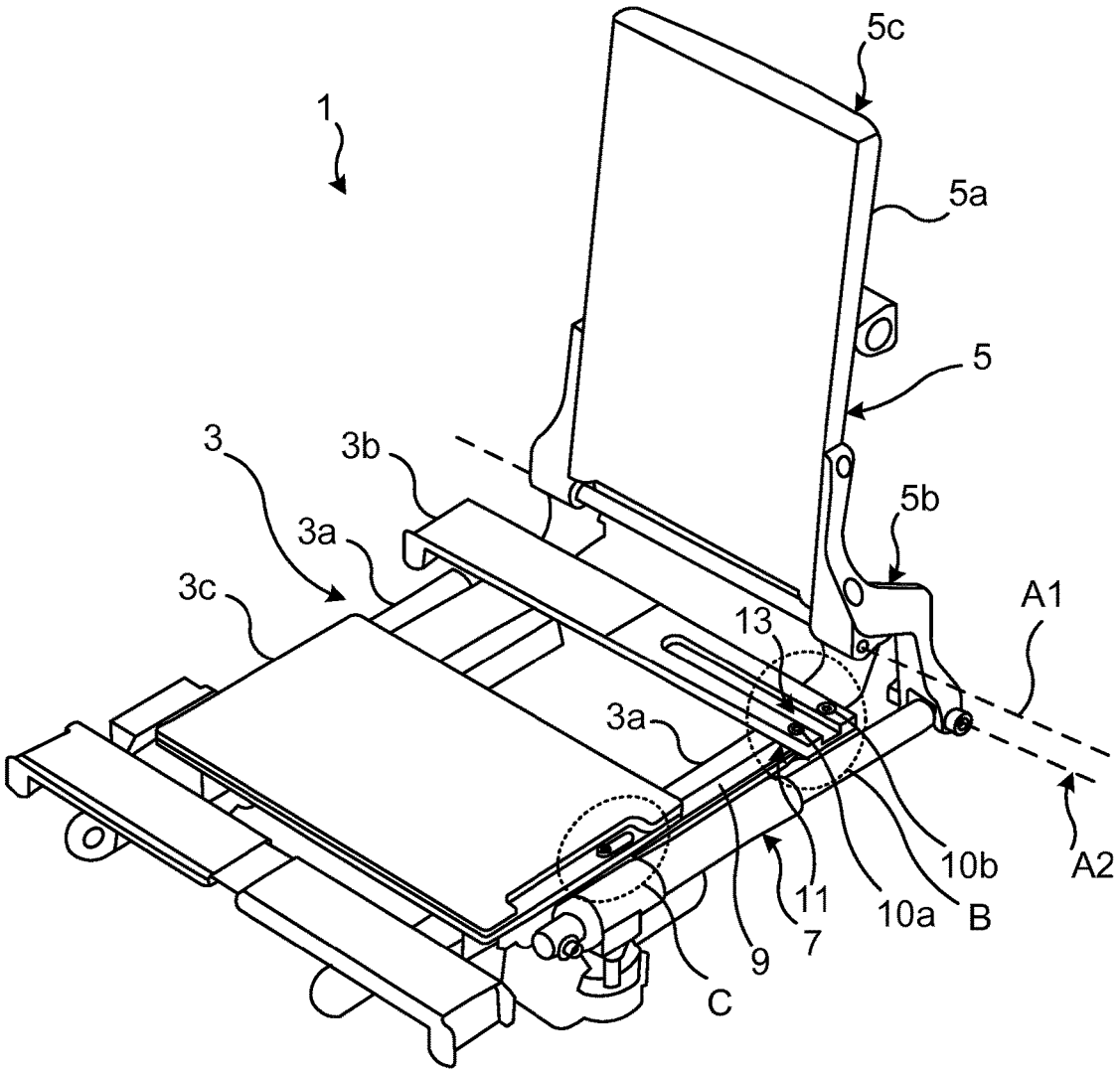
FIG. 1 is a schematic perspective view of an example of seat arrangement for an electrically powered wheelchair, with the backrest frame in an upright position.

FIG. 1 shows an example of a seat arrangement 1 for an electrically powered wheelchair. The seat arrangement 1 comprises a mounting arrangement (not shown), for mounting the seat arrangement 1 to a chassis of an electrically powered wheelchair, a seat frame 3, a backrest frame 5, a backrest actuator 7, and a backrest actuator bracket 9. The backrest actuator 7 is fixedly attached to the backrest actuator bracket 9, in a first position relative to the seat frame 3. The backrest actuator bracket 9 is attached to the seat frame 3. Normally, the backrest actuator bracket 9 is fixedly attached to the seat frame 3. However, in the event that the backrest frame 5 is subjected to a forward-tilting force greater than a threshold value, the backrest actuator bracket 9 is forcedly translated relative to the seat frame 3, resulting in that also the backrest actuator 7 is moved relative to seat frame 3 from the first position to a second position.

The backrest frame 5 is pivotally coupled to the seat frame 3, thereby forming a first pivot axis A1. The backrest frame 5 is pivotally coupled to the backrest actuator 7, thereby forming a second pivot axis A2. The first pivot axis A1 and the second pivot axis A2 are parallel. The backrest frame 5 is pivotable relative to the seat frame 3 by a translation of the second pivot axis A2, resulting in pivoting of the backrest actuator 7 relative to the backrest frame 3. The backrest frame 5 will thereby pivot about the first pivot axis A1. Pivoting of the backrest frame 5 is normally obtained by means of the backrest actuator 7, which is operable by an electric motor.

In the following it will be elaborated upon seat arrangement designs which in a sense provides maneuvering of the backrest actuator 7 to a second position relative to the seat frame 3 by means of a large enough forward-tilting force acting on the backrest frame 5, and locking of the backrest actuator 7 in the second position.

The seat arrangement 1 comprises a first fastener 10*a* and a second fastener 10*b*. The first fastener 10*a* may for example be a bolt, a pin, a screw or similar means. The second fastener 10*b* may for example be a bolt, a pin, a screw or similar means. The first fastener 10*a*, which is fixedly arranged relative to the seat frame 3 and to the backrest actuator bracket 9, and the second fastener 10*b*, which is slidably arranged relative to the backrest actuator bracket 9, attach the backrest actuator bracket 9 to the seat frame.

The seat arrangement 1 comprises a retaining mechanism 11 formed by the backrest actuator bracket 9, the seat arrangement 3 and the first fastener 10*a*. The seat arrangement 1 comprises a locking mechanism 13 formed by the backrest actuator bracket 9, the seat arrangement 3 and the second fastener 10*b*. Neither the retaining mechanism 11 nor the locking mechanism 13 are shown in detail in FIG. 1, but will in the following be elaborated upon with reference to FIGS. 3 and 6.

In the event that a forward-tilting force that is equal to or greater than a threshold value acts on the backrest frame 5, the backrest frame 5 is moved towards a forward-tilted position, wherein the first fastener 10*a* breaks and the second fastener 10*b* slides relative to the seat frame 3. The backrest actuator bracket 9 therefore slides relative to the seat frame 3 until stopped by the locking mechanism 13. Since the backrest actuator 7 is fixedly attached to the backrest actuator bracket 9, the backrest actuator 7 is also moved relative to the seat frame 3 to a second position, and since the backrest actuator bracket 9 is locked by the locking mechanism 13, the backrest actuator 7 is locked in the second position. The locking of the backrest actuator 7 results in that the position of the second pivot axis A2 is locked, and can thus no longer translate. The backrest frame 5 is therefore locked in its forward-tilted position.

In the example shown in FIG. 1, the seat frame 3 comprises several parts, namely two side beams 3*a* perpendicular to the first pivot axis A1 and a rear transverse element 3*b* extending between the two side beams 3*a* and a front transverse element 3*c* extending between the two side beams 3*a*. It should be noted that a number of variations of the seat frame is envisaged.

In the example in FIG. 1, the backrest frame 5 comprises a backrest portion 5*a* and a slewing bracket 5*b*, which in this example has a knee portion. The backrest portion 5*a* extends from a backrest frame top 5*c* to the first pivot axis A1. A portion of slewing bracket 5*b* extends between the first pivot axis A1 and the second pivot axis A2, where it is pivotally coupled to the backrest actuator 7.

Figure 5:
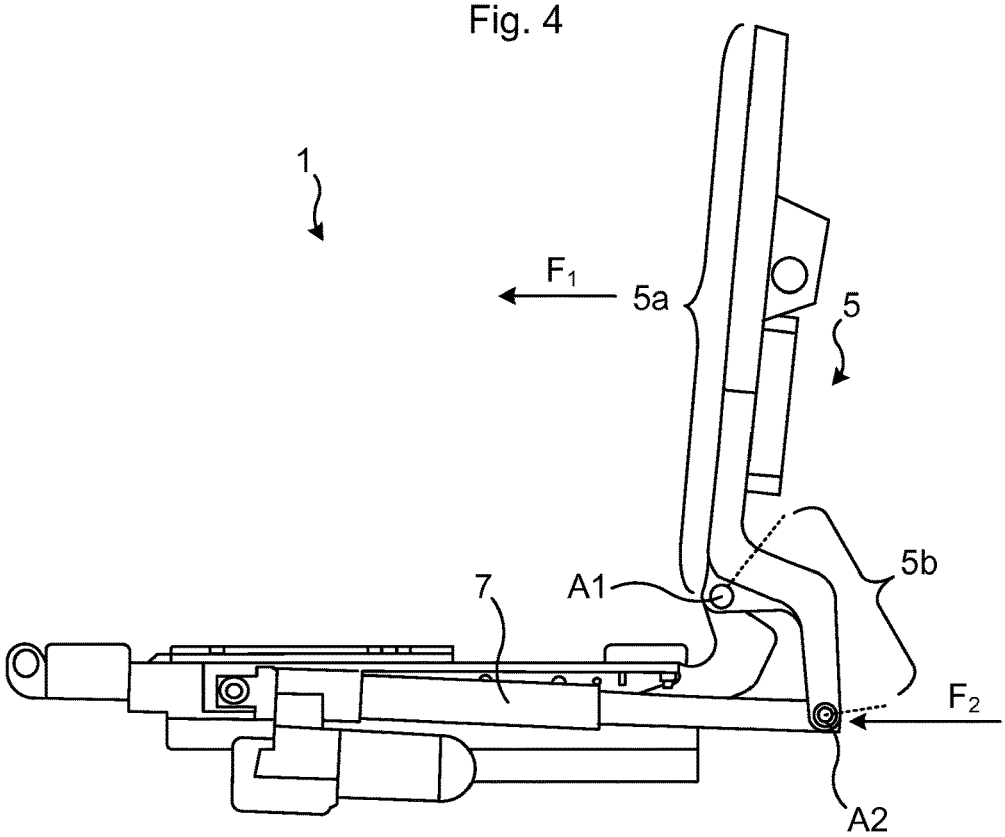
FIG. 5 is a side view of the seat arrangement in FIG. 1.

The backrest portion 5*a* and the slewing bracket 5*b* are more clearly shown in FIG. 5. A first moment arm is defined between the first pivot axis A1 and a forward-tilting force F1, which has its line of action at the centre of gravity of the backrest portion 5*a*. A second moment arm is defined between the first pivot axis A1 and a counteracting force F2 having its line of action on the slewing bracket 5*b*. As long as the forward-tilting force F1, as shown in FIG. 5, acting on the backrest portion 5*a* provides an equal moment about the first pivot axis A1 as the counteracting force F2 acting on the slewing bracket 5*b* provides at the second pivot axis A2, the backrest frame 5 is in an equilibrium state. However, if a first moment provided by the forward-tilting force F1 upon the backrest portion 5*a* is greater than a second moment provided by the counteracting force F2, the backrest frame 5 will be tilted forwards.

Figure 2:
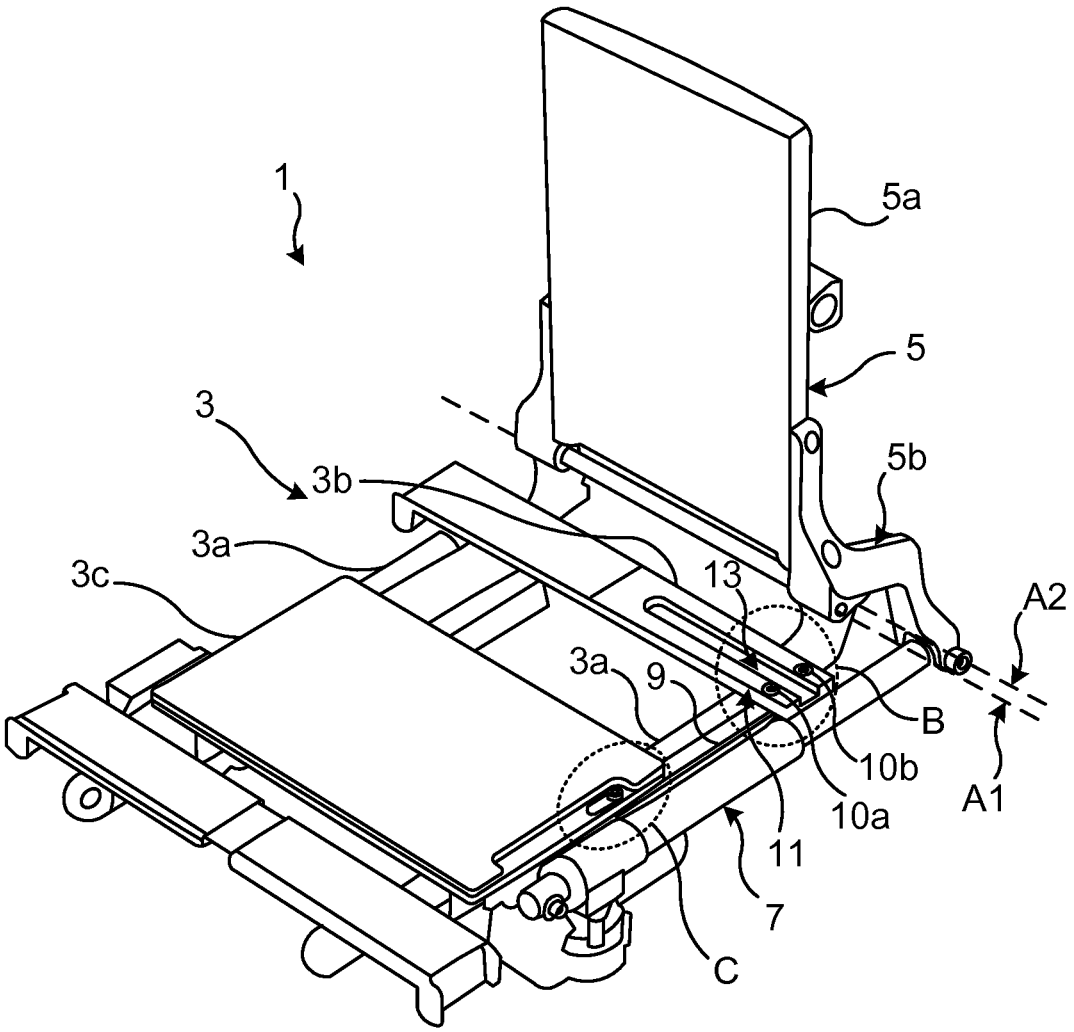
FIG. 2 is a schematic perspective view of the seat arrangement in FIG. 1 with the backrest frame arranged in a forward-tilted position.

FIG. 2 shows the seat arrangement 1 when the backrest frame 5 is in the forward-tilted position, and the backrest actuator 7 is in the second position.

Figure 3:
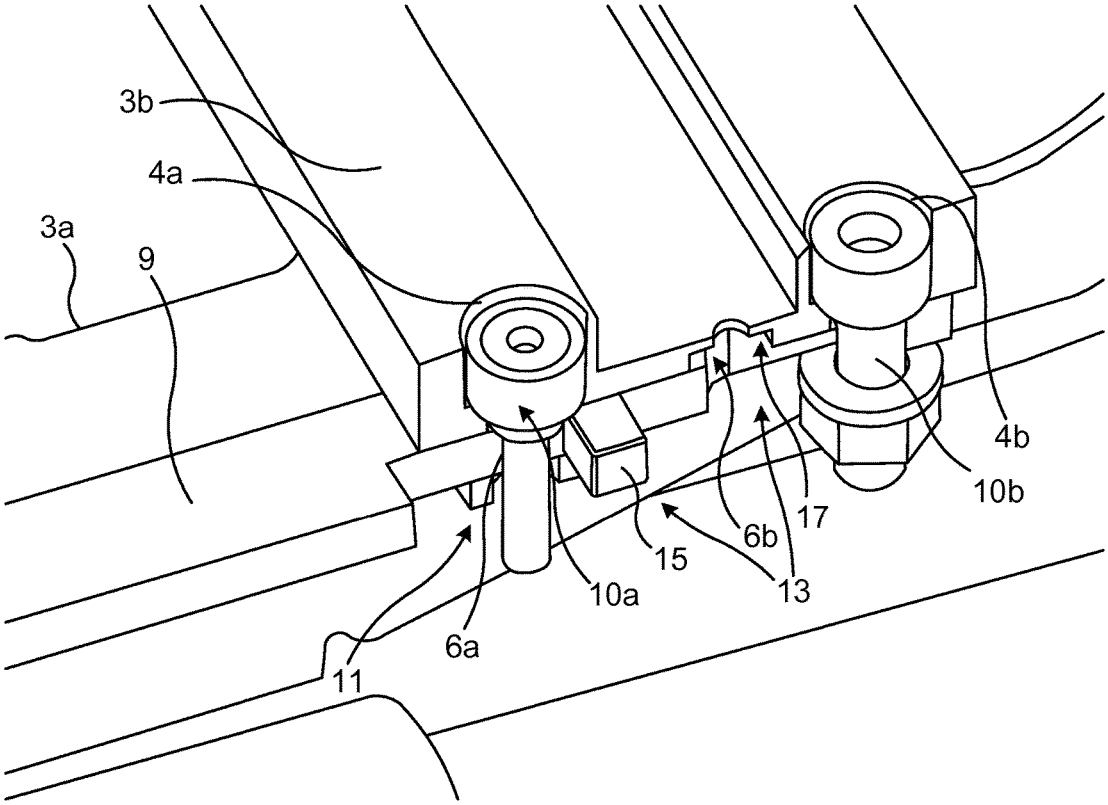
FIG. 3 is a close-up view of a retaining mechanism and a locking mechanism of the seat arrangement with the backrest frame in the upright position as shown in FIG. 1.

The function of the seat arrangement 1 in the event of a collision will now be described with reference to FIGS. 3-8. FIG. 3 shows a close-up view of the area B shown in FIG. 1, in a section to expose the retaining mechanism 11 and the locking mechanism 13. In FIG. 3, the backrest frame 3 is in the upright position, which would correspond to a state of the seat arrangement 1 before a collision.

The seat frame 3 comprises a first seat frame through-opening 4*a*, and the backrest actuator bracket 9 comprises a first backrest actuator bracket through-opening 6*a*. The first fastener 10*a* is arranged in the first seat frame through-opening 4*a* and the first backrest actuator bracket through-opening 6*a*, thereby attaching the backrest actuator bracket 9 to the seat frame 3. The first seat frame through-opening 4*a*, the first backrest actuator bracket through-opening 6*a*, and the first fastener 10*a* forms the retaining mechanism 11.

The seat frame 3 comprises a second seat frame through-opening 4*b*, and the backrest actuator bracket 9 comprises a first backrest actuator bracket slotted through-opening 6*b*. The second fastener 10*b* is arranged in the second seat frame through-opening 4*b* and slidably arranged in the first backrest actuator bracket slotted through-opening 6*b*. The backrest actuator bracket 9 is thereby allowed to slide relative to the seat frame 3 when the backrest frame 5 is subjected to a forward-tilting force that is greater than a threshold value.

The seat arrangement 1 comprises an energy accumulating element, such as a leaf spring, and a key 15 biased by the energy accumulating element. The backrest actuator bracket 9 has a slot in which the key 15 is arranged, and the key 15 is biased in a direction away from the slot bottom. Alternatively, the slot may be arranged in the opposite direction and the key may then be biased away from the slot top, and the keyway may be arranged at a level below the key, wherein the key is pressed down into the keyway to obtain locking by means of the locking mechanism.

The seat frame 3 comprises a keyway 17 arranged to receive the key 15. Normally, the key 15 is displaced relative to the keyway 17. In particular, the keyway 17 is arranged downstream of the key 15, relative to the motion of the backrest actuator bracket 9 in relation to the seat frame 3 when moved as a result of a forward-tilting force acting on the backrest frame 5 greater than a threshold value. During this motion, the key 15 slides towards the keyway 17 and it is pushed into the keyway 17 by the energy accumulating element. The key 15 and the keyway 17 form the locking mechanism 13.

The first fastener 10*a* has a first mechanical strength and the second fastener 10*b* has a second mechanical strength. The second mechanical strength is higher than the first mechanical strength. The first fastener 10*a* would hence when subjected to shearing forces above a threshold value break before the second fastener 10*b* subjected to the same shearing force would break. As an example, the first fastener may for some electrically powered wheelchairs have M4 size, while the second fastener may have M6 size.

Figure 4:
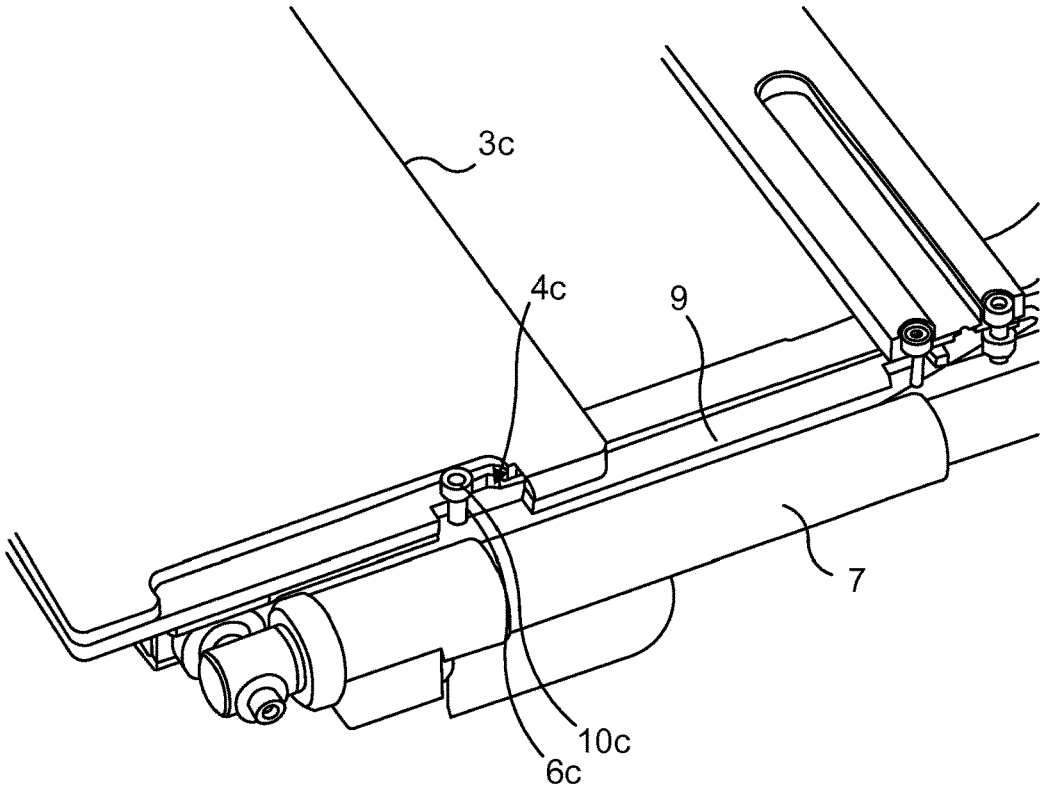
FIG. 4 is a close-up view of a front portion of the seat arrangement in FIG. 1.

FIG. 4 shows a front portion of the seat arrangement 1, including area C in FIG. 1, when the backrest frame 5 is in the upright position. The seat arrangement 1 comprises a third fastener 10*c*, the seat frame 3 comprises a first seat frame slotted through-opening 4*c*, and the backrest actuator bracket 9 comprises a second actuator backrest bracket through-opening 6*c*. The third fastener 10*c* is arranged in the first seat frame slotted through-opening 4*a* and the second actuator backrest bracket through-opening 6*c*. The backrest actuator bracket 9 is thereby attached to the front transverse element 3*c* of the seat frame 3. The first fastener 10*a* and the second fastener 10*b* hence attaches the backrest actuator bracket 9 at one end thereof to the seat frame 3, and the third fastener 10*c* attaches the backrest actuator bracket 9 at the other end thereof to the seat frame 3. The third fastener 10*c* is slidably arranged in the first seat frame slotted through-opening 4*c* such that it can slide in the first seat frame slotted through-opening 4*c* to enable movement of the backrest actuator bracket 9 relative to the seat frame 3 when the backrest frame 5 is subjected to a forward-tilting force that is greater than a threshold value.

Figure 6:
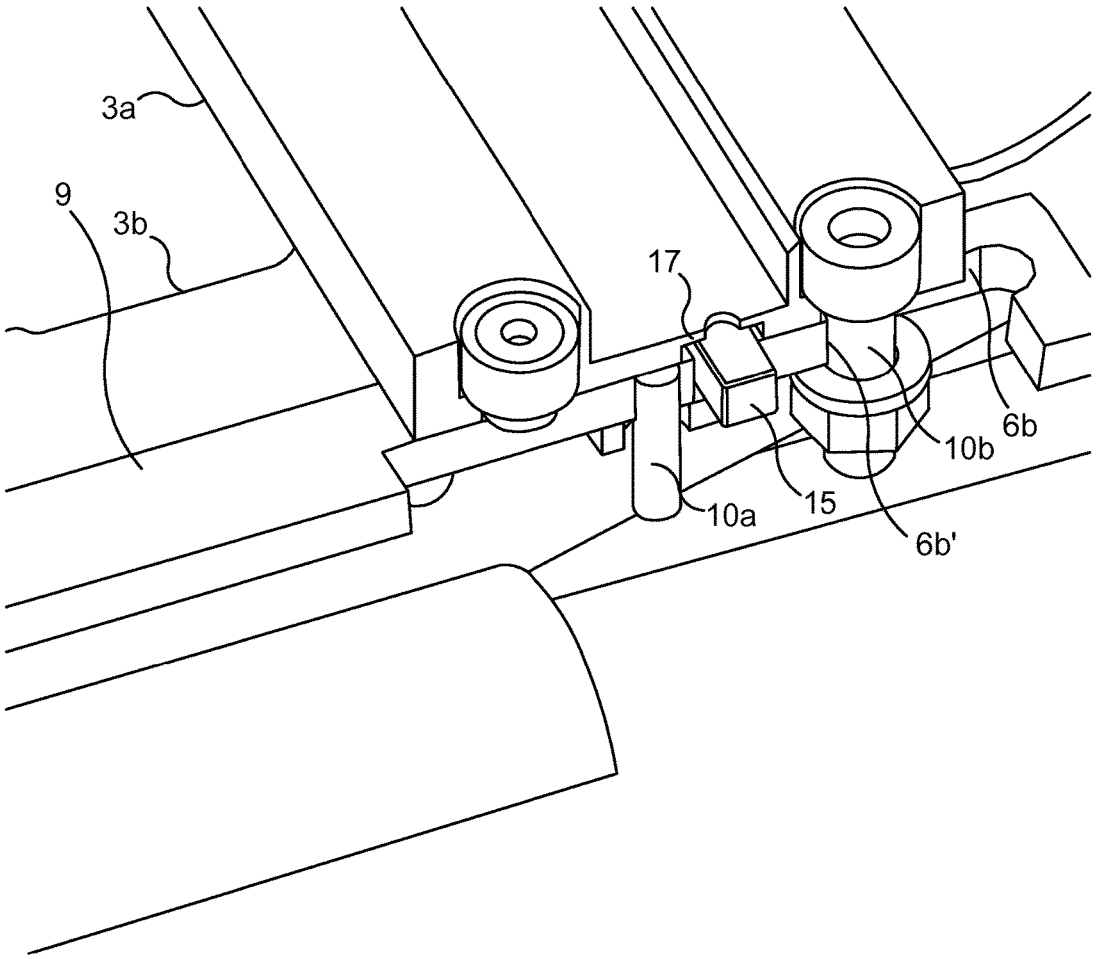
FIG. 6 is a close-up view of the retaining mechanism and the locking mechanism of the seat arrangement with the backrest frame in the forward-tilted position as shown in FIG. 2.

FIG. 6 shows a close-up view of the area B shown in FIG. 2, in a section to expose the retaining mechanism 11 and the locking mechanism 13. In FIG. 6, the backrest frame 3 is in the forward-tilting position, which would correspond to a state of the seat arrangement 1 after a collision.

In FIG. 6 it can be seen that the retaining mechanism 11 has released the backrest actuator bracket 9, and allowed movement of the backrest actuator bracket 9 relative to the seat frame 3. The first fastener 10*a* has been subjected to a shearing force due to the forward-tilting force F1 that has acted on the backrest frame 3, and has as a result broken. The breaking of the first fastener 10*a* triggers the movement of the backrest actuator bracket 9 relative to the seat frame 3.

As the backrest actuator bracket 9 slides in the rear direction, the key 15 moves towards the keyway 17 until it is received by the keyway 17. Concurrently, the second fastener 10*b* slides in the first backrest actuator bracket slotted through-opening 6*b* until it reaches the front wall 6*b*' of the first backrest actuator bracket slotted through-opening 6*b*. Since the second fastener 10*b* has a higher mechanical strength than the first fastener 10*a*, it would typically not break during a collision, but instead abut the front wall 6*b*' and provide a stop for the forward-tilting motion of the backrest frame 5.

Figure 7:
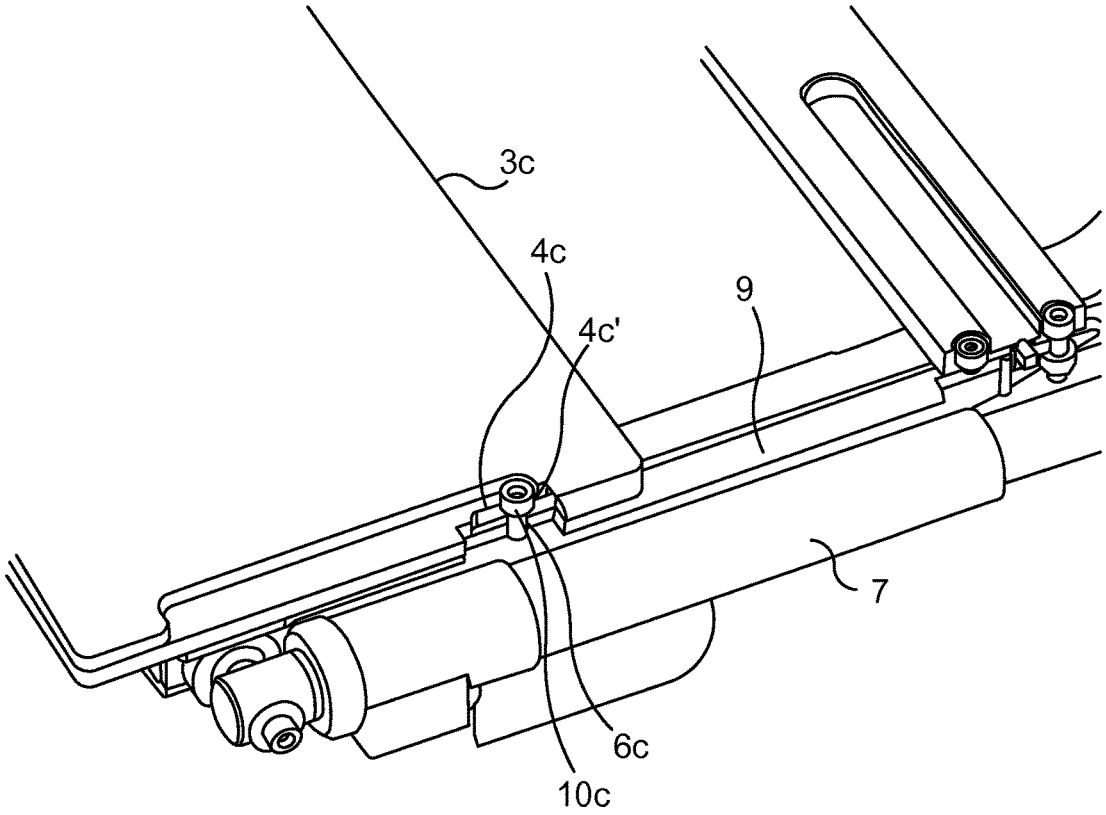
FIG. 7 is a close-up view of the front portion of the seat arrangement in FIG. 2.
Figure 8:
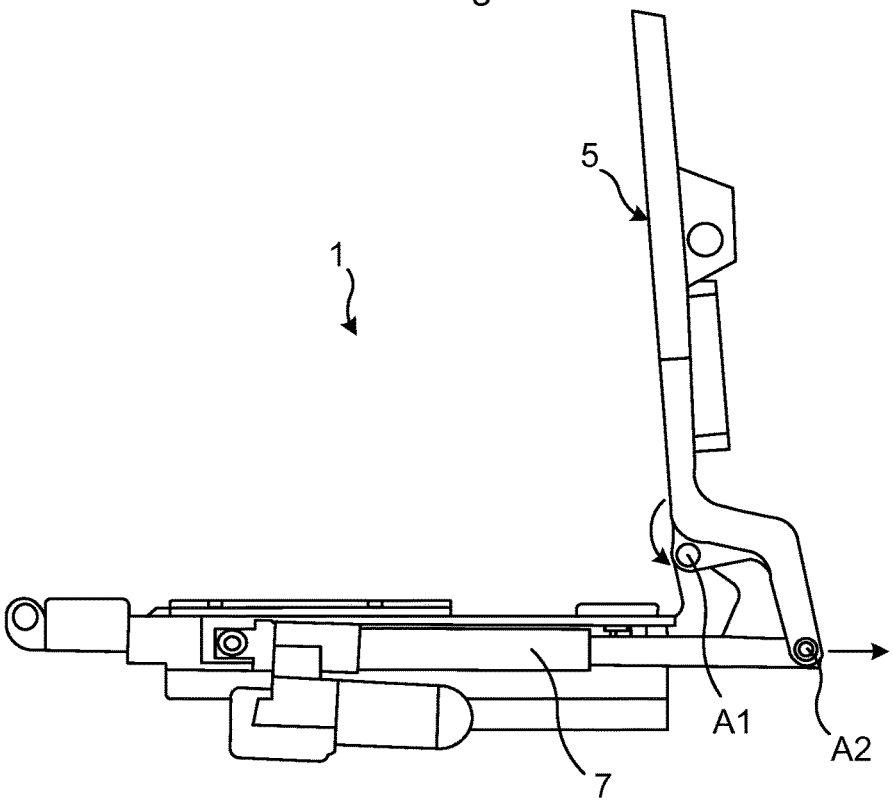
FIG. 8 is a side view of the seat arrangement in FIG. 2.

FIG. 7 shows a front portion of the seat arrangement 1, including area C in FIG. 2, when the backrest frame 5 is in the forward-tilted position. The third fastener 10*c* has, as the backrest actuator bracket 9 has slid relative to the seat frame 3, slid along the first seat frame slotted through-opening 4*c* to the rear wall 4*c*' of the first seat frame slotted through-opening 4*c*.

Movement of the actuator bracket 9 relative to the seat frame 3, leads to the same amount of movement of the backrest actuator 7, which is fixedly attached to the backrest actuator bracket 9, from the first position to the second position. The backrest frame 3 hence obtains its forward-tilted position shown in FIG. 8.

A suitable amount of movement of the backrest actuator bracket 9 and thus of the backrest actuator 7 may for example be in the range 10-15 mm. For a 12 mm allowed movement distance, forward-tilting of the backrest frame 5 provides an forward-tilting angle of about 8-9°, which has shown to provide a surprisingly high improvement in reducing the rebounding distance in the event of a collision. The amount of allowed movement of the backrest actuator bracket 9 may be designed by suitable dimensioning of the length of the first seat frame slotted through-opening 4*c*, the first backrest actuator bracket slotted through-opening 6*b*, and the position of the key 15 relative to the keyway 17.

Another example of a seat arrangement will now be described with reference to FIGS. 9 and 10. The seat arrangement is similar to the seat arrangement 1, except that in the present example, the backrest actuator bracket is fixedly attached to the seat frame, without the above-described possibility of relative movement between the seat frame and the backrest actuator bracket.

According to this example, backrest actuator 7' comprises the retaining mechanism and the locking mechanism.

According to one variation, the backrest actuator could be mounted directly to the seat frame, and the seat arrangement would in this case thus not comprise a backrest actuator bracket.

The backrest actuator 7' comprises a first member 23 and a second member 25. The second member 25 is arranged to receive the first member 23. The first member 23 is normally fixed to the second member 25 by means of a retaining mechanism 11'. The first member 23 comprises a first though-opening and the second member 25 comprises a corresponding second through-opening. The backrest actuator 7' further comprise a fourth fastener 21 arranged in the first through-opening and the second through opening. The first member 23 is thereby fixed to the second member 25. The first through-opening, the second through-opening and the fourth fastener 21 form the retaining mechanism 11'. The fourth fastener 21 may for example be a bolt, a pin, a screw or similar means.

Figure 9:
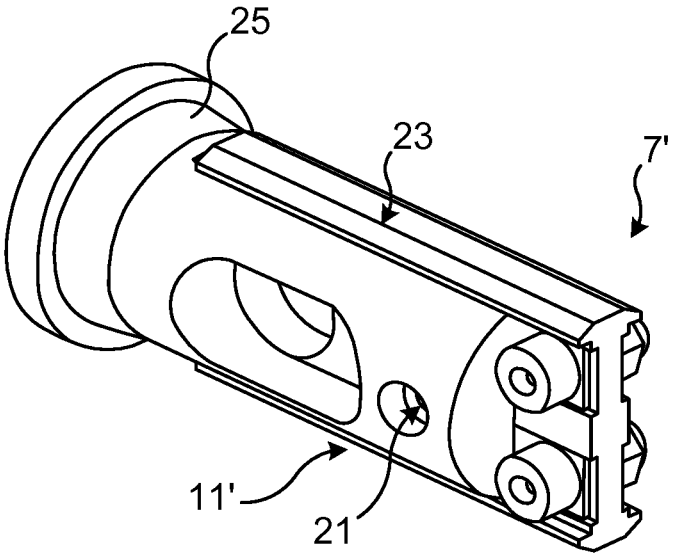
FIG. 9 is a perspective view of section of a portion of a backrest actuator according to another example of the seat arrangement, when the backrest frame is in an upright position.
Figure 10:
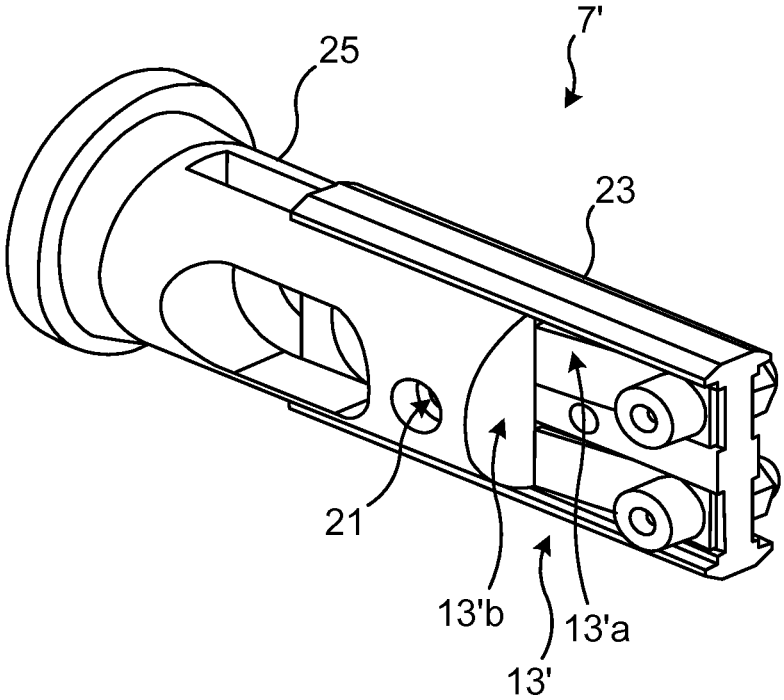
FIG. 10 is a section of a portion of a backrest actuator in FIG. 9 when the backrest frame is in forward-tilting position.

In FIG. 9, the backrest actuator 7' is arranged in the first position. In FIG. 10, the backrest actuator 7' is arranged in the second position. The first member 23 has moved relative to the second member 25, due to translation of the second pivot axis A1, as a result of the backrest frame moving to the forward-tilting position. The fourth fastener 21 is designed to break when subjected to a shearing force greater than a threshold value determined e.g. in crash tests. The retaining member 11' thereby provides relative linear movement between the first member 23 and the second member 25, and thus a movement of the backrest actuator 7' relative to the seat frame 3.

The first member 23 has a locking member 13'*a*. Normally, the second member 25 covers the locking member 13'*a*, the inner surface of the second member 25 being essentially parallel with the locking member 13'*a*. However, when the first member 23 and the second member 25 are translated relative to each other and the backrest actuator 7' obtains its second position, the locking member 13'*a* slides out from below the second member 25 and is thereby released. The locking member 13'*a* thereby provides a blocking surface towards the end face 13'*b* of the second member 25. The locking member 13'*a* and the end face 13'*b* form the locking mechanism 13'. The locking member 13'*a* may for example be flexible e.g. a leaf spring, which bends outwards when released, or it could be wedge-shaped. The locking mechanism 13' prevents the first member 23 from sliding into the second member 25, and thus the backrest actuator 7' is locked in the second position.

In general, the mechanical withstand strength any of the fasteners disclosed herein, i.e. of the first fastener, the second fastener, the third fastener, and the fourth fastener may be determined for example empirically in crash tests and/or analytically in simulations and/or by means of equilibrium equation calculations. The threshold value may for example be set in view of a lowest crash velocity in which it would be desirable to provide the herein described forward-tilting of the backrest frame.

Additional variations of the seat arrangement will now shortly be described. According to one variation, the slewing bracket may be designed to deform when the forward-tilting force is equal to or greater than the threshold value. The slewing bracket may in this case form the retaining mechanism in the sense that when a forward-tilting force is below the threshold value the slewing bracket maintains its shape and hence prevents the backrest frame from obtaining the forward-tilted position. The slewing bracket also comprises the locking mechanism, in the sense that unless the forward-tilting force has an extreme magnitude, only a certain deformation will occur, wherein the backrest frame is locked in the forward-tilted position. Thus, when the backrest frame is subjected to a high enough forward-tilting force, the slewing bracket is deformed, e.g. stretched or extended, allowing the backrest frame to tilt about the first pivot axis.

According to one variation, the slewing bracket has a hinge mechanism, which comprises the retaining mechanism and the locking mechanism. In case the backrest frame is subjected to a forward-tilting force equal to or greater than the threshold value, the hinge mechanism will allow pivoting of the slewing bracket about a pivot axis formed by the hinge mechanism, wherein the hinge mechanism locks the slewing bracket when the backrest frame has obtained the forward-tilted position.

Figure 11:
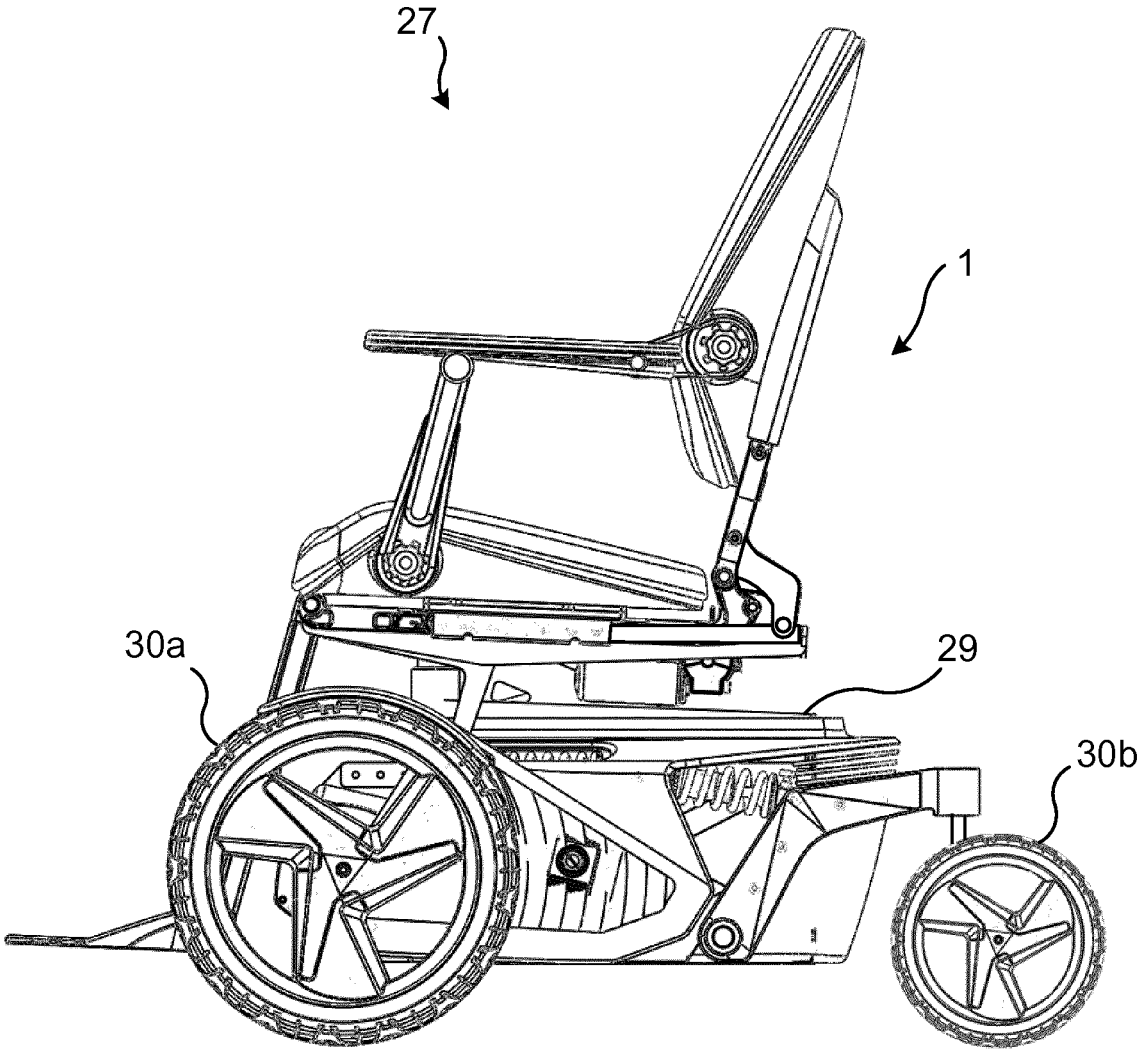
FIG. 11 shows an example of an electrically powered wheelchair comprising a seat arrangement such as the one shown in FIG. 1.

FIG. 11 depicts a schematic side view of an example of an electrically powered wheelchair 27. The electrically powered wheelchair 27 comprises a chassis 29, a seat arrangement 1 attached to the chassis 29, and wheels 3*oa* and 3*ob*. The chassis 29 may according to one variation comprise a lift mechanism or a tilt/lift mechanism, and the seat arrangement 1 may be mounted to the tilt mechanism or tilt/lift mechanism. The exemplified electrically powered wheelchair 27 is of front wheel drive type. It should however be noted that alternatively the wheelchair could be of for example midwheel drive type, back wheel drive type, four wheel drive type or six wheel drive type.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. A seat arrangement for an electrically powered wheelchair, wherein the seat arrangement comprises:

a mounting arrangement for mounting the seat arrangement to a chassis of an electrically powered wheelchair, a seat frame, a backrest frame, a backrest actuator, wherein the backrest frame is pivotally coupled to the seat frame, forming a first pivot axis, and wherein the backrest frame is pivotally coupled to the backrest actuator, forming a translatable second pivot axis, a retaining mechanism arranged to retain the backrest frame in an upright position while the backrest frame is subjected to a forward-tilting force smaller than a threshold value, wherein the retaining mechanism is arranged to allow movement of the backrest frame to a forward-tilted position when the backrest frame is subjected to a forward-tilting force equal to or greater than the threshold value, and a locking mechanism arranged to lock the backrest frame in the forward-tilted position.

2. The seat arrangement of claim 1, wherein the retaining mechanism is arranged to retain the backrest actuator in a first position while the backrest frame is subjected to the forward-tilting force smaller than a threshold value, wherein the backrest frame is arranged to pivot about the first pivot axis and the second pivot axis to obtain a forward-tilted position when the backrest frame is subjected to a forward-tilting force equal to or greater than the threshold value, wherein the retaining mechanism is arranged to allow movement, corresponding to the translation of the second pivot axis, of the backrest actuator to a second position, and wherein the locking mechanism is arranged to lock the backrest actuator in the second position to thereby lock the backrest frame in the forward-tilted position.

3. The seat arrangement of claim 1, wherein the backrest frame is arranged to pivot about the first pivot axis and the second pivot axis to the forward-tilted position when an equilibrium state acting about the first pivot axis is broken by the forward-tilting force.

4. The seat arrangement of claim 1, comprising a backrest actuator bracket attached to the seat frame, wherein the backrest actuator is fixedly attached to the backrest actuator bracket.

5. The seat arrangement of claim 4, wherein the locking mechanism is arranged to lock the backrest actuator bracket relative to the seat frame to thereby lock the backrest actuator in the second position.

6. The seat arrangement of claim 4, comprising a first fastener, wherein the seat frame has a first seat frame through-opening and the backrest actuator bracket has a first backrest actuator bracket through-opening, wherein the first fastener is arranged in the first seat frame through-opening and in the first backrest actuator bracket through-opening.

7. The seat arrangement of claim 6, wherein the first fastener, the first seat frame through-opening and first backrest actuator bracket through-opening form the retaining mechanism.

8. The seat arrangement of claim 6, comprising a second fastener, wherein the seat frame has a second seat frame through-opening and the backrest actuation bracket has a first slotted backrest actuation bracket through-opening wherein the second fastener is arranged in the second seat frame through-opening and slidably arranged in the first backrest actuation bracket slotted through-opening.

9. The seat arrangement of claim 8, wherein the first fastener has a first mechanical strength and the second fastener has a second mechanical strength, wherein the second mechanical strength is higher than the first mechanical strength.

10. The seat arrangement of claim 8, comprising a third fastener, wherein the seat frame comprises a first seat frame slotted through-opening, and wherein the backrest actuator bracket comprises a second backrest actuator bracket through-opening, wherein the third fastener is arranged in the second backrest actuator bracket through-opening and slidably arranged in the first seat frame slotted through-opening.

11. The seat arrangement of claim 6, wherein the seat frame comprises a keyway and the backrest actuator bracket comprises a biased key which form the locking mechanism, wherein the first fastener is designed to break when the backrest frame is subjected to a forward-tilting force equal to or greater than the threshold value allowing sliding of the backrest actuator bracket relative to the seat frame, wherein the biased key is arranged to engage the keyway to lock the backrest actuator in the second position.

12. The seat arrangement of claim 11, wherein the locking mechanism comprises a leaf spring, wherein the key is biased by the leaf spring.

13. The seat arrangement of claim 1, wherein the backrest actuator comprises the retaining member and the locking member.

14. An electrically powered wheelchair comprising:

a chassis, and the seat arrangement of claim 1 attached to the chassis.

* * * * *